US005406757A

United States Patent [19]

Fleishman

[11] Patent Number: 5,406,757

[45] Date of Patent: Apr. 18, 1995

[54] STRESSED PANEL STRUCTURE

[76] Inventor: Gregg R. Fleishman, 2732 S. La Cienega, Los Angeles, Calif. 90034

[21] Appl. No.: 184,241

[22] Filed: Jan. 19, 1994

Related U.S. Application Data

[62] Division of Ser. No. 793,101, Nov. 15, 1991, abandoned.

[51] Int. Cl.[6] ..... E04B 7/00

[52] U.S. Cl. ..... 52/82; 135/15.1

[58] Field of Search ..... 52/80, 81, 82; 446/111, 446/112, 113; 135/15.1, 23, 25.3, 31, 33.5, 33.4, 37, 119

[56] References Cited

U.S. PATENT DOCUMENTS 2,690,187 9/1954 Thompson ..... 135/15.1
3,345,786 10/1967 Buzzela et al. ..... 52/82 X
3,454,022 7/1969 Ferguson ..... 135/15.1

FOREIGN PATENT DOCUMENTS 16587 of 1912 United Kingdom ..... 135/15.1

*Primary Examiner*—Carl D. Friedman
*Assistant Examiner*—Creighton Smith
*Attorney, Agent, or Firm*—Lyon & Lyon

[57] ABSTRACT

A Stressed Panel Structure forming checkerboard spheroids and non-checkerboarded conical sections are formed using semi-rigid panels of wood or other materials with generally elongated slots or holes in their corners. Panels are placed corner to corner and a pin or rod is inserted therebetween, becoming stressed when panels are positioned at proper dihedral angles along their axis of intersection. Stressing results generally in bending or other distress of the panel or pin or both.

12 Claims, 5 Drawing Sheets

Fig. 1.
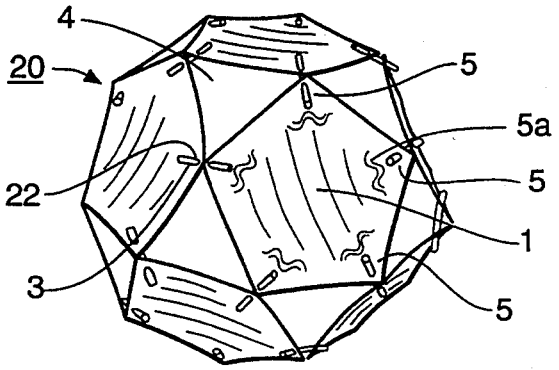
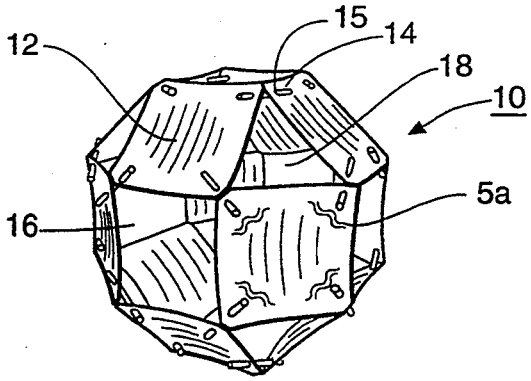
Fig. 2.
Fig. 3.
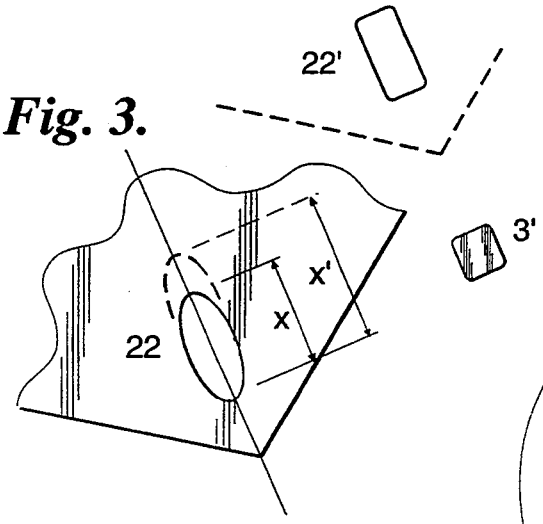
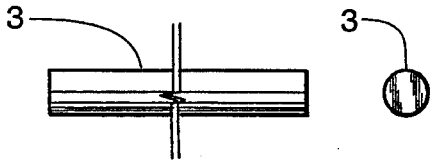
Fig. 4.
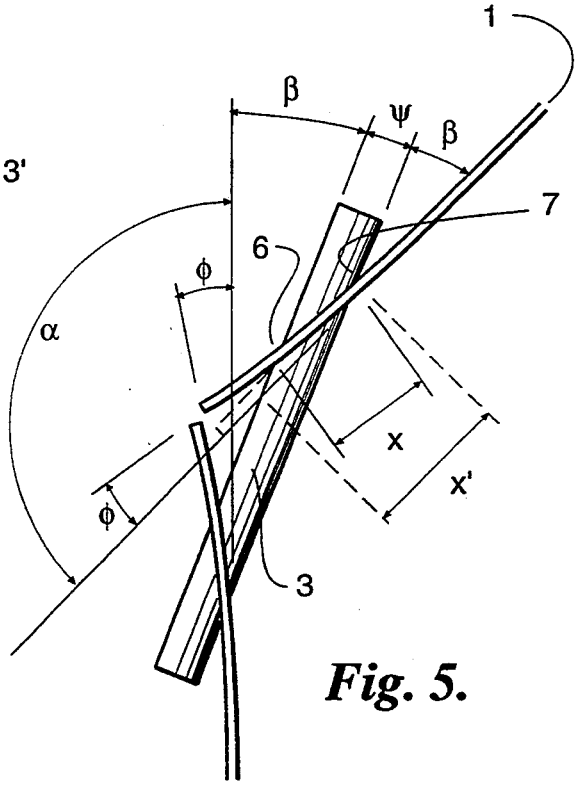
Fig. 5.

STRESSED PANEL STRUCTURE

This is a divisional of application Ser. No. 07/793,101 filed Nov. 15, 1991, now abandoned.

BACKGROUND OF THE INVENTION

Panel structures that are known in the art have used bendable panels and panels with a combination of connecting devices and frames to create structures.

Generally, panel structures used for shelter or habitation they have evolved into spherical forms when they have entirely been constructed of panels. This form results because of its structural and geometric efficiency. Generally aligned in some manner related to geodesics, which reduce the numbers of different types of component parts, experimental thin panel structures have been constructed to 40' diameter using bent ¼" plywood sheets bolted together face to face on overlapping portions of the panels. These structures have relied on bending to achieve the spherical curvature and therefore generally have been constructed of thin panels without adequate strength to support surface loading and have had long portions of their edges or surfaces in contact.

The basic frame geodesic structure as is known in the art, has a basic frame structure normally covered with an appropriate skin or panel to provide a weather-tight enclosure. These surface panels generally can be thick enough to support surface loading as they do not bend; rather, they meet angularly along the lines of the geodesic frame structure to which they are attached for support. In some cases, where the frame elements are pre-attached to the surface panels, the structures could be called panel structures although the load bearing parts of the structure are comprised of the frame. However no significant bending forces or axial loads are imposed on the panels, with the exception of their own weight and applied surface loading as described above.

Additionally some kind of attachment device is required at the intersections of the structural panels or frames. Bolts, nuts, straps, clamps, and similar securing devices have been used in the past. Normally, such fasteners are made of metal and require special tools for securing the same. Further, where bolt holes and the like are provided, fairly close tolerances and angular preciseness must be maintained in the dimensioning of all of the component parts in order that proper registration will occur to enable proper fastening of the various panels to the frame. U.S. Pat. No. 4,308,698 Jan. 5, 1982, also by this inventor and incorporated herein by reference discloses bendable panels are also used to simplify the methods of connection. However, the preferred embodiment provides a frame structure where only the connecting device is the bendable portion of reference and although the secondary embodiment is a bendable panel structure, it utilizes continuous edges for connection; and the flexibility required necessitates thin panels unable to support surface loading. Additionally all of the panels are triangular in its spherical form.

All of the foregoing characteristics of prior art structures make the assembly and disassembly of such structures a time-consuming operation. Moreover, because of the various different types of fastening means employed, not only are special tools required, but the overall expense of manufacture and of the materials employed is greater. Using fewer different types of component parts and a wider selection of materials would reduce the overall cost.

SUMMARY OF THE INVENTION

With the foregoing considerations in mind, the present invention contemplates panel structures or portions thereof, consisting primarily of panels of similar shapes and sizes as the dominant structural elements. No additional skeletal framework of linear strut members is required, except where strut-like members form the connections between panels but do not transfer loads across them.

These panels generally meet angularly and have sufficient strength to support surface loading. Although connections can be conventional, a key feature of the invention is how the panels are utilized so as to simplify and minimize the number of interconnecting devices.

Briefly, in this new invention, individual panels are formed of semi-rigid material and are dimensionally shaped so that the corners only can flex upon installation so that bending forces are created. These bending forces are not utilized to achieve the spherical curvature but are utilized in the method of attachment. This attachment can be accomplished using simple pins, which can be constructed from a variety of materials, and can be either rigid or flexible, depending upon the specific application and the comparable stiffness of the panels. The pins are held in place due to friction provided by the panels which are under bending stresses exerting forces generally in a direction perpendicular to the axis of the individual pin. This reliance on bending forces negates the need for other attachment devices or bonding materials such as glue.

The panels can be constructed in a variety of shapes. Common shapes used for a preferred embodiment include panels that are substantially triangular, square and polygonal. (e.g.: pentagonal, hexagonal, etc.) Each panel has a series of slots or holes (these terms are used interchangeably hereinafter), with a single slot generally located near each outward vertex of each panel. The panels are interconnected using pins that are inserted into the slots of corresponding panels. Generally, a triangular panel is used for cone shapes and will have two holes for interconnection at the structure's edges and another type of connector at the third (center) vertex. A square panel is used for spherical forms and will have four holes; a pentagonal panel will also be used for spheres and have 5 holes, and so forth.

The disclosed stressed panel structure can be utilized in a number of different configurations and applications. The spheroidal forms consist of two twelve panel forms, one made of squares and one made of pentagons, and one 42 panel form made of 12 pentagons and 30 hexagons. These numbers of panels form full spheroids. In addition, lesser numbers of panels similarly aligned form various portions thereof. It is contemplated that other combinations are possible using similar structures. The characteristic checkerboard appearance of the spheroids results from the panel placement. The panels are placed and interconnected vertex to vertex such that open spaces result on either side of each connection. In all but one embodiment, these open spaces are generally triangular.

In the conically formed structures, the panels are generally triangular in nature, some tending toward being pie shaped. These structures can each be formed from combinations of like panels, such combinations consisting of at least three panels, with a possibility of eight or more. The pin members are generally arranged in a circular array and connect the outward corners. The panels are placed with their sides adjacent and the resultant structure does not exhibit the same checkerboard effect of the spheroidal structures. They do occasionally result in a generally circular opening at the center portion or top which can be connected by attachment means to the ancillary support structure, which is in many instances a pole.

In the spheroidal forms, the bending forces applied to the panel by the interconnecting pins generally result in concave panel deformations relative to the curvature of the structure when the pin members are straight. When the pin members are not straight but are bent or formed in other ways, stresses can produce a resultant structure where the panels are convexly bent. In the conical sections the panels, after being interconnected, can be either of concave or convex form.

BRIEF DESCRIPTION OF THE DRAWINGS

A more thorough disclosure of the features of the present invention is set out in the brief descriptions of the drawings which are described below:

FIG. 1 is a perspective view of one of the preferred embodiments using the stressed panel structures. This embodiment contains 12 panels that are shaped substantially pentagonal. The gaps between the panels in this embodiment are shaped substantially triangular.

FIG. 2 is a perspective view of one of the preferred embodiments using 12 panels that are shaped substantially square.

FIG. 3 is a top view of the vertex of a panel, illustrating the location of the slot or hole near the corner of the panel. In this embodiment, the hole is shaped substantially elliptical. A substantially rectangular hole and a substantially square pin are also illustrated.

FIG. 4 illustrates a side view and an end view of a cylindrical pin that could be utilized in combination with the embodiment illustrated in FIG. 3.

FIG. 5 is a side view of the interconnection of two corresponding panels, showing the geometry of the pin inserted through the two slots in the vertices of the panels.

DETAILED DESCRIPTION OF DRAWINGS

Figure 6:
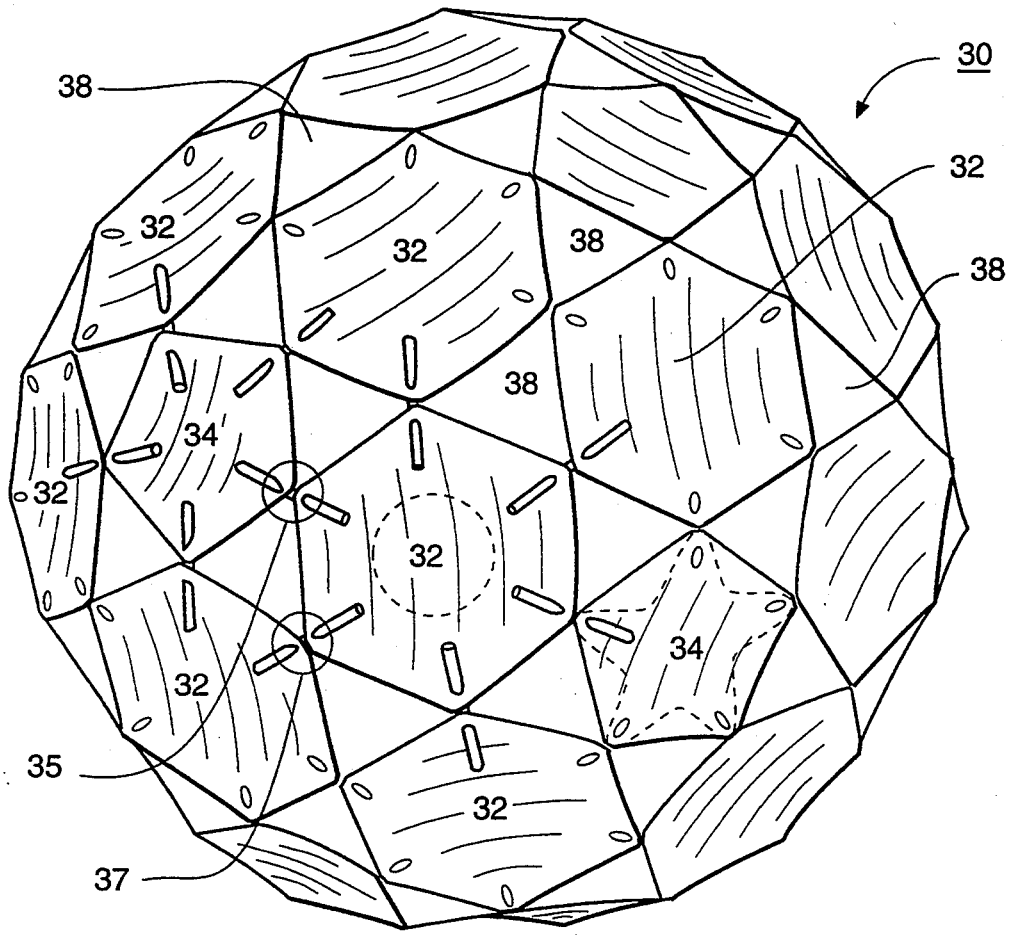
FIG. 6 is a perspective view of a spheroid constructed using 12 substantially pentagonal panels and 30 substantially hexagonal panels.

The present invention relates to a stressed panel structure that has, inter alia, a series of stressed panels that are interconnected to each other with a series of slots and pins.

Turning now to a detailed description of the preferred embodiments, illustrated in FIGS. 1 through 7. Individual panels are used in such a way as to create a stressed panel structure. FIG. 1 illustrates one configuration of a checkerboard spheroid 20, utilizing 12 pentagonally shaped panels (1). In this configuration, identical panels 1 are used for the entire structure. Each outward vertex 5 of each panel is connected to an outward vertex of a corresponding panel, to create a structure. Each of the panels has a slot 22 formed near the outer portion of each vertex. These slots can be of different shapes, depending upon the shape of the connecting pin 3. FIG. 3 illustrates an oval slot 22 designed to function with a cylindrical pin 3 as shown in FIG. 4. FIG. 3 also illustrates a rectangular slot 22', designed to function with a square pin 3'.

The panels 1 are manufactured individually and are generally planar prior to integration into the structure. The structure is assembled by inserting the pins into the slots and then flexing the panels, resulting in bending stresses exerted primarily near the outward vertices 5 of the panels 1 where the slots 22 and the pins 3 are situated. The center of the panel is substantially unstressed with the areas of maximum stress shown generally by wavy lines 5*a* indicating their general concentration and location. FIG. 5 shows the geometric arrangement of the panels and pins. The panels create twisting forces that are exerted perpendicular to the axis of the pin. The effect is that the pin will be held in place by the resulting force and friction. The tensioned panels are constrained from further movement due to the relative rigidity of the tensioned pins.

The length of the hole or the slot varies with the amount of bending of the panels. FIGS. 3 and 4 show the length of the slot required in the bent configuration (X), versus that which would be required if the panels were straight (X'). As the length of the hole gets shorter, the angle of deflection ($\phi$) gets larger. The angle of deflection is the angle between the panel at rest and the deflected panel. This results in a larger twisting force exerted in the pin at points 6 and 7 in FIG. 5. This twisting force acts to hold the pins and panels together. As long as X is significantly less than X', adequate bending forces will be applied. The pin angle ($\beta$) and the dihedral angle ($\alpha$) are inherent and fixed by the shape of the structure. The panels are held in place by bending forces and do not need to be precision fit.

An entire structure can be constructed using various panel and pin combinations. FIG. 1 shows such a structure using pentagonal panels. In FIG. 1, substantially pentagonal panels 1 are attached by means of holes 22 and pins 3 located at the vertices of the pentagons. The pentagonal panels 1 create adjacent triangular openings 4. This method of construction can also be used to create hemispherical or other sections which are portions of a sphere.

FIG. 2 shows a structure 10 using square panels. FIG. 2 shows a structure comprised of substantially square panels 12 connected to other square panels at their vertices by pin 14 and hole 15 assemblies of the same nature as those shown in FIG. 1. By virtue of the vertex to vertex alignment openings 16 which are square and openings 18 which are triangles are formed in a checkerboard pattern comprising the structure.

Figure 7:
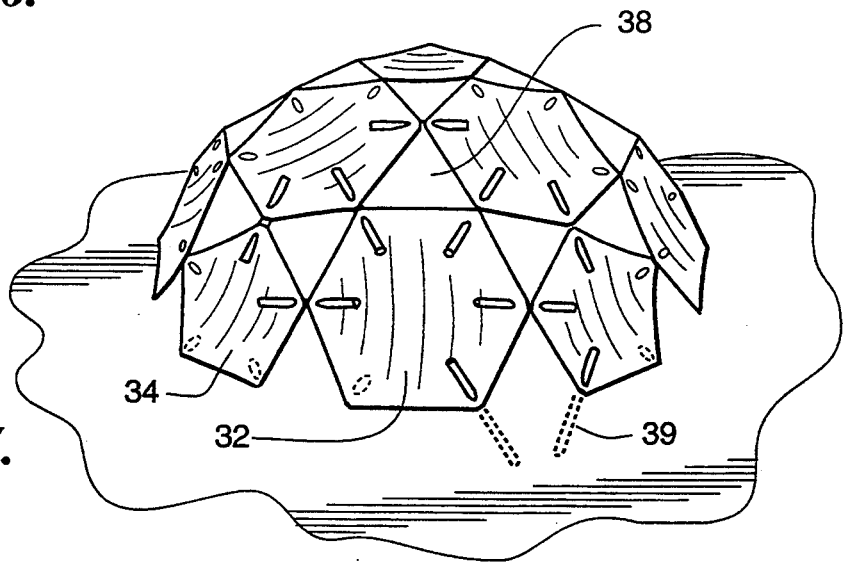
FIG. 7 is a perspective view of the top half of the structure showing in FIG. 6, illustrating its use as a dome.

Different shaped panels could be used in the same structure. For example, FIG. 6 and 7 illustrate an embodiment where pentagonal shaped panels are used with hexagonal panels. The structure 30 in FIG. 6, is constructed by joining 30 substantially hexagon shaped panels 32 to substantially pentagonal shaped panels 34 and other substantially hexagonal shaped panels. Pentagonal-hexagonal connections are generally shown at numeral 35 while hexagonal to hexagonal connections are generally shown at numeral 37. On opposite sides of each connection point 35 and 37 are triangular openings 38 of which eighty (80) are comprised within a full spheroid form. Pin and hole (or slot) assemblies as shown in FIGS. 1–9 are used to connect the panels. Conventional attachments such as brackets and bolts (FIG. 17) can also be used with these structures. Also, as with other figures the drawings are abbreviated and not necessarily to scale, and no pins and holes are shown in some panels. Portions of all of the disclosed structures can also be used. For example, FIG. 7 illustrates how such structures can be used for habitation, using a portion of the structure generally disclosed in FIG. 6. The open triangular spaces 38 can be used as windows when translucent members are inserted in the open spaces. Pins 39 are used as connecting members to the ground or to a conventional foundation or base (not shown).

Figure 8:
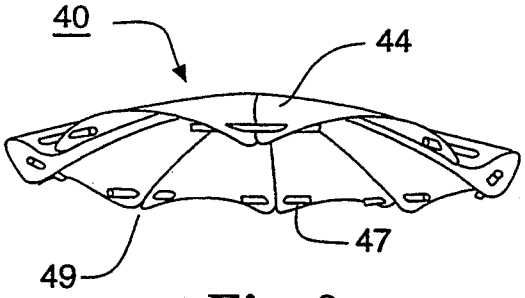
FIG. 8 is a side view of an embodiment using substantially triangular panels to form a conically shaped structure. The panels are flexed to form convex sections, when viewed from below.
Figure 9:
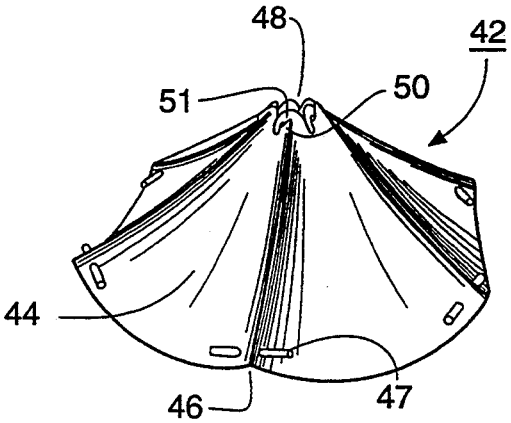
FIG. 9 is a top view of an embodiment using substantially triangular panels to form a conically shaped structure. The panels are flexed to form concave sections, when viewed from below.

FIGS. 8 through 12 depict variations of the use of the panel and pin combinations to construct conical structures. These may be used as, for example, umbrella or lamp structures. FIGS. 8 and 9 illustrate conically shaped structures 40 and 42 that are formed in the shape of an umbrella using panels 44 that are substantially triangular. Interconnections 46 and 49 at the outer edges of the panels are made using the same system described earlier, whereby the pins 47 are held in place by the forces exerted by tensioned panels 44.

FIG. 9 shows a variation of the interconnection means for one corner of the substantially triangular panels 44. The retention means 48 shown illustrate a tongue 51 and notch 50 configuration. This interconnection is shown to emphasize that the tensioned member interconnection can be used in conjunction with other conventional attachment means.

Figure 10:
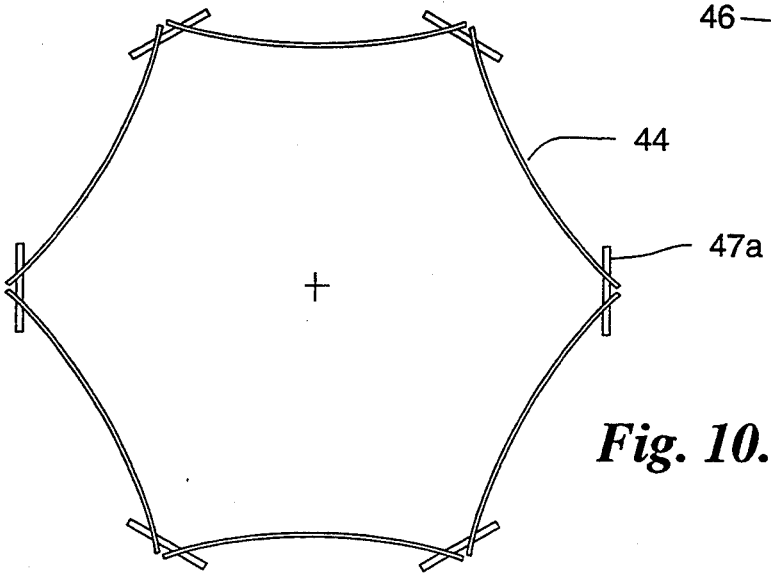
FIG. 10 is a horizontal, rotationally segmented section, illustrating the location of the pins and the bending of the panels of the conical object shown in FIG. 9.
Figure 11:
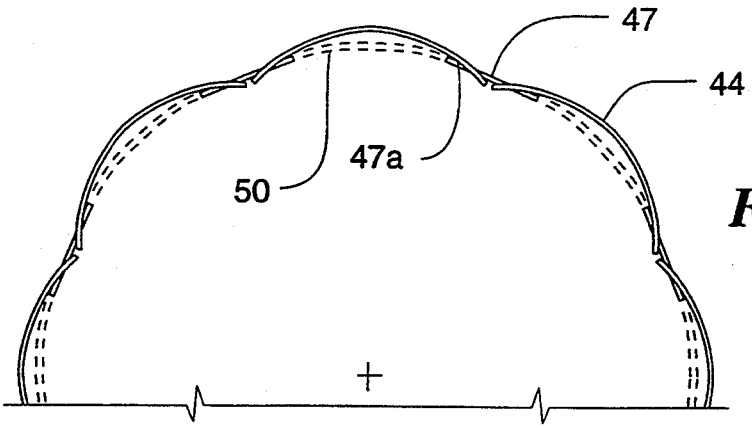
FIG. 11 illustrates the location of the pins and the bending of the panels of the conical object shown in FIG. 8. The dashed lines illustrate the continuous bar that can be used, as shown in FIG. 15.

FIGS. 8 through 11 also show that the panels can be flexed outward or inward from the center of a conical structure. For panels that are flexed inward (concave), as shown in FIGS. 9 and 10, the ends of the pins 47*a* protrude to the outside of the conical structure. For panels that are flexed outward (convex), as shown in FIGS. 8 and 11, the ends 47*a* of the pins protrude to the inside of the conical structure. Of course, the pin 47 could be continuous as indicated by the dotted lines 50. This is further indicated by pin 60 in FIG. 15.

Figure 12:
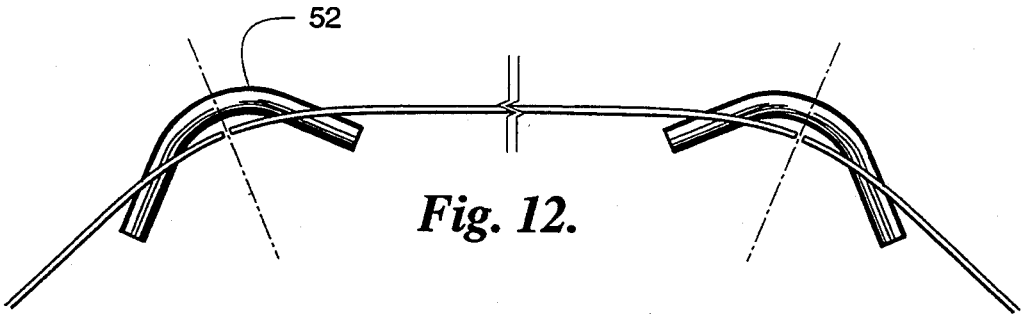
FIG. 12 illustrates a convex panel structure using bent pins.

FIG. 12 shows an alternate configuration for the pin and panel combination cut along Section AA in FIG. 6 where the pins are bent.

Figure 13:
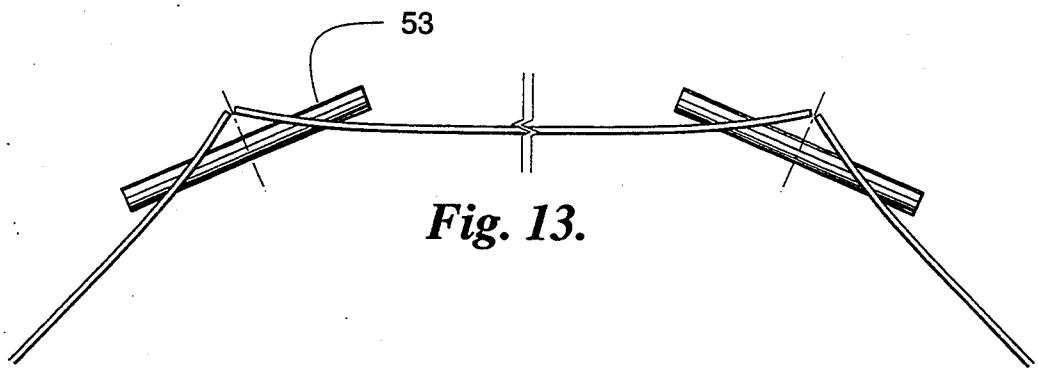
FIG. 13 illustrates a concave panel structure using straight pins.

FIG. 13 indicates the pin and panel combination cut along section AA in FIG. 6.

Integration of the panels and pins can be accomplished in two different ways. One method is to use bent pins 52 as shown in FIG. 12. Bent pins are particularly appropriate for structures using convex panels, where the pin angle $\phi$ is small (pin angle $\phi$ is illustrated in FIG. 5). Conversely, straight pins 53 can be used, as shown in FIG. 13.

Figure 14:
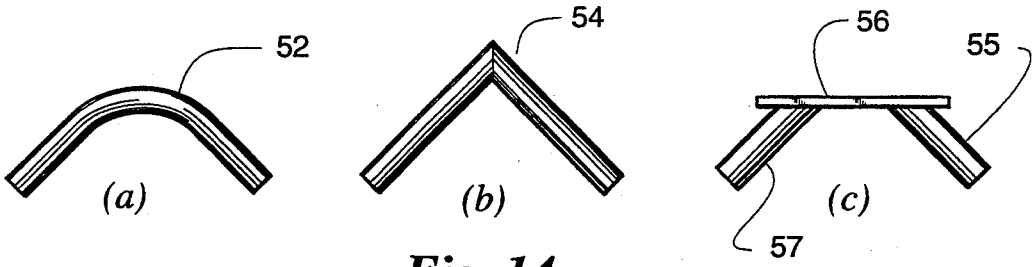
FIGS. 14*a–c* illustrates possible embodiments for bent pins.
Figure 17:
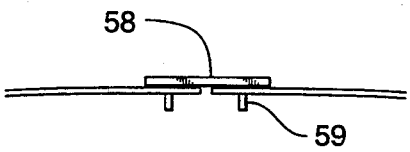
FIG. 17 illustrates conventional means for fastening panels to one another.

FIG. 14 illustrates various embodiments of bent pins. FIG. 14(*a*) illustrates the bent pin 52 of the same type showing FIG. 12. FIG. 14(*b*) illustrates an angle pin 54. FIG. 14(*c*) shows a pin formed by welding pin sections 57 to flat plate 56. Of course, straight pins 53 such as those set out in FIG. 13 can be used, while conventional means for attachment such as a member 58 and bolts or rivets 59 are shown in FIG. 17.

Figure 15:
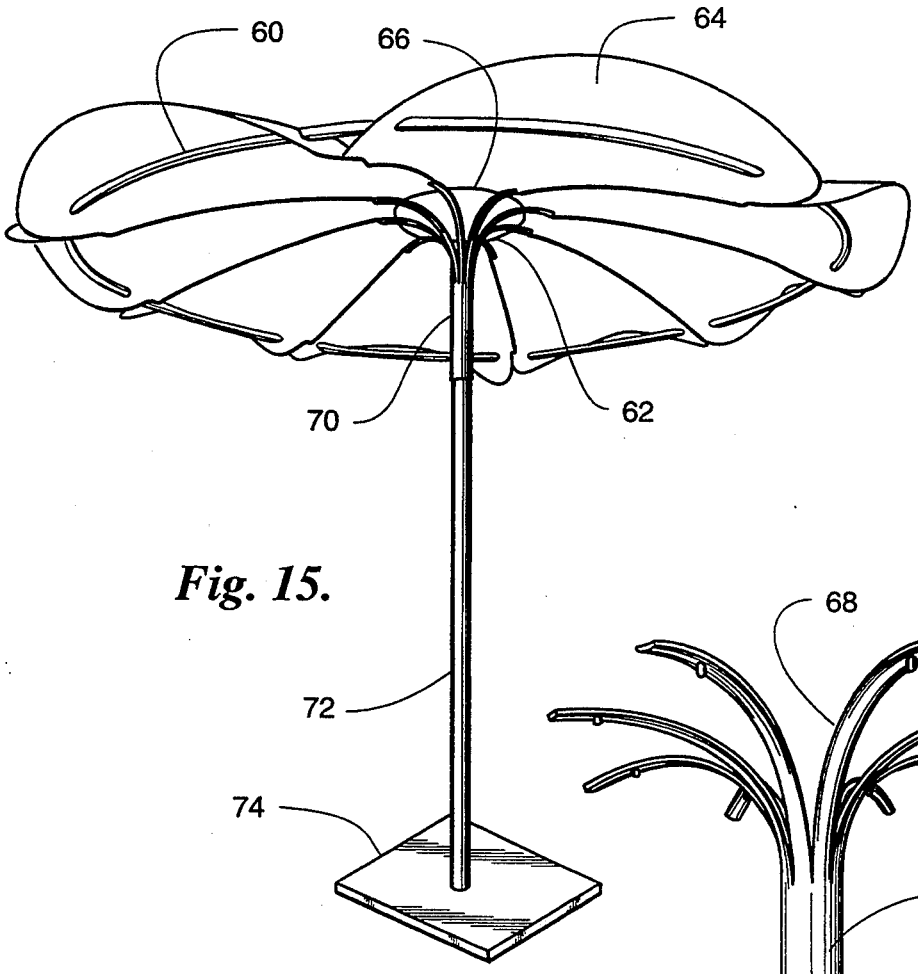
FIG. 15 shows an embodiment where substantially triangular panels form a substantially conical shape. In this embodiment, individual pins are replaced with a continuous bar that runs the entire circumference of the structure, and the individual panels are attached by conventional means to a center support that has a sectionally splayed tube.
Figure 16:
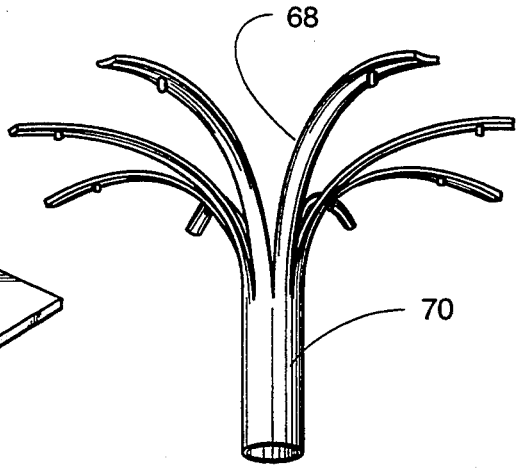
FIG. 16 is an enlarged view of the sectionally splayed tube shown in FIG. 15.

FIG. 15 shows another variation in configuring the panels. The primary difference with this conical structure (which can be used as a lamp or on a larger scale, as an umbrella), versus that shown in FIGS. 8 through 12, is that multiple, discrete pins have been replaced with a single, continuous "pin" 60, that spans the entire circumference of the structure. FIGS. 15 and 16 also illustrate a variation in the attachment 62 of the center vertex of each of the substantially triangular panels 64. The center vertices 66 of each panel are attached to the center support 70 using conventional means instead of tongue and notch assemblies such as those in FIG. 9. This embodiment illustrates the use of a tube or pole 72 sitting on base 74 fitted to center support 70 shaped as a sectionally splayed tube having fingers 68 attached integrally to provide the attachment means for the center support. See FIG. 16.

Thus, an improved structure is disclosed. While the embodiments and applications of this invention have been shown and described, it would be apparent to those skilled in the art that many more modifications are possible without departing from the inventive concepts herein. The invention therefore is not to be restricted except in the spirit of the appended claims.

I claim:

1. A conical structure comprised of:

(a) generally triangular planar panel members made of a semi-rigid material, said panel members having sufficient thickness and rigidity to withstand bending forces, such forces being dependent on relative size of panel member and particular forces required by each application;

(b) said panel members having a plurality of slots or holes for inserting interconnecting pins;

(c) said pins of appropriate size and rigidity to withstand bending forces exerted by tensioned panel members;

(d) said panel members placed under a bending stress, creating a force generally perpendicular to the axis of said pins;

(e) said panel members and said pins used in combination to create a conical structure;

(f) said panel members attached in the center using a tongue and groove retention means.

2. The conical structure of claim 1 wherein said slots or holes are oriented toward the outer vertices of said panel members.

3. The conical structure of claim 1 wherein said conical structure is supported using a center support;

(a) said center support is connected to said panel members using a sectionally splayed tube.

4. The conical structure of claim 1 wherein said conical structure uses one continuous pin that spans the circumference of the conical structure.

5. A conical structure comprising:

(a) a plurality of substantially triangular members each said member having at least three vertices, and holes through at least two of said vertices;

(b) a plurality of pins;

(c) said pins connecting at least two said members at said vertices having a hole, each said member forming connections with at least two other said members at said vertices; and (d) said connections being held together by a friction force between said pins and said vertices, said friction force being created in part by a bend in said members.

6. The structure of claim 5 wherein each said member has a center vertex and two outer vertices said outer vertices having said holes.

7. The structure of claim 5 wherein said center vertices are elevated relative to said outer vertices.

8. The structure of claim 6 further comprising a center axis, said members being radially arranged about said center axis, and each said member being connected to two adjacent members.

9. The structure of claim 8 wherein said members bend convexly relative to said center axis.

10. The structure of claim 6 wherein a first said pin connects all said outer vertices in series; said first pin being circular and continuous.

11. The structure of claim 6 further comprising a support pole having a sectionally splayed top, said top forming a plurality of fingers, and said center vertices being attached to said fingers.

12. The structure of claim 11 wherein said members bend concavely relative to said center axis and said center vertices are connected by integral notches and projections.

* * * * *